US009824814B2

(12) United States Patent
Ruiz Escobedo et al.

(10) Patent No.: US 9,824,814 B2
(45) Date of Patent: Nov. 21, 2017

(54) ACOUSTIC PANELS FOR TRANSFORMERS

(71) Applicant: PROLEC GE INTERNACIONAL, S. DE R.L. DE C.V., Apodaca (MX)

(72) Inventors: Sergio Camilo Ruiz Escobedo, Guadalupe (MX); Eduardo Herrera Saucedo, General Escobedo (MX); Jaime Esparza López, Guadalupe (MX)

(73) Assignee: Prolec Ge Internacional, S. DE R.L. DE C.V., Apodaca (MX)

( * ) Notice: Subject to any disclaimer, the term of this patent is extended or adjusted under 35 U.S.C. 154(b) by 0 days.

(21) Appl. No.: 15/168,352

(22) Filed: May 31, 2016

(65) Prior Publication Data

US 2017/0110239 A1 Apr. 20, 2017

(30) Foreign Application Priority Data

Oct. 14, 2015 (MX) ..... MX/a/2015/014449

(51) Int. Cl.
*G10K 11/168* (2006.01)
*H01F 27/33* (2006.01)

(52) U.S. Cl.
CPC ..... *H01F 27/33* (2013.01); *G10K 11/168* (2013.01)

(58) Field of Classification Search
CPC ..... H01F 27/33; G10K 11/168
USPC ..... 181/202
See application file for complete search history.

(56) References Cited

U.S. PATENT DOCUMENTS 2,870,858 A * 1/1959 Adams ..... H01F 27/33 181/202
3,077,946 A * 2/1963 Wilkins ..... H01F 27/33 181/202
4,082,141 A * 4/1978 Perretta ..... H01F 27/06 165/69
4,215,763 A * 8/1980 Pasko ..... H01F 27/33 181/202
4,371,858 A * 2/1983 Kanoi ..... H01F 27/33 181/202
4,442,419 A * 4/1984 Kanoi ..... H01F 27/33 181/202
4,497,387 A * 2/1985 Reiplinger ..... H01F 27/02 181/202
4,514,714 A 4/1985 Kanoi et al.
4,558,296 A * 12/1985 Thoren ..... H01F 27/33 181/202
6,236,575 B1 * 5/2001 Ritter ..... H01H 50/305 181/198
6,321,557 B1 * 11/2001 Scrivener ..... F04B 39/0033 181/202
8,689,932 B2 * 4/2014 Dupont ..... F16M 1/00 181/200

(Continued)

FOREIGN PATENT DOCUMENTS

CN 201478084 U 5/2010
EP 0048990 A2 4/1982
EP 0087121 A1 8/1983

*Primary Examiner* — Forrest M Phillips
(74) *Attorney, Agent, or Firm* — The Webb Law Firm

(57) ABSTRACT

Acoustic panel for transformers comprising an acoustic insulation system and a fastening system, able to reduce the level of noise caused by operation of said transformers, having a reduced size and low weight, allowing easy installation and replacement.

6 Claims, 4 Drawing Sheets

(56) References Cited

U.S. PATENT DOCUMENTS

2016/0104568 A1* 4/2016 Best ..... H01F 5/02
336/199

* cited by examiner

ACOUSTIC PANELS FOR TRANSFORMERS

CROSS-REFERENCE TO RELATED APPLICATION

This application claims priority to Mexican Patent Application No. MX/a/2015/014449 filed Oct. 14, 2015, the disclosure of which is hereby incorporated in its entirety by reference.

TECHNICAL FIELD OF THE INVENTION

The present invention relates to acoustic panels for reducing noise level caused by the operation of electrical transformers and more specifically to a panel consisting of a plurality of layers with a unique spatial arrangement, which allows to reduce the level of noise emissions under 25 decibels.

BACKGROUND OF THE INVENTION

The operation of electrical transformers generates a flow in its nucleus, and an effect called magnetostriction that produces a deformation in the plates that conform it, causing vibrations that are transmitted through the oil until becoming a noise similar to a buzz, which can be annoying, depending on the area where the transformer is located.

Due to the fast growing of the urban sprawls, it is increasingly common to have to install electrical transformers near residential areas, causing an increase in noise pollution of the environment.

Over the years various solutions have been developed, focused on attacking the generation, transmission and emission of vibrations, to reduce the noise caused by the operation of electrical transformers in order to place them in locations near population centers. When total noise requirement is 20 dB or more under NEMA, solutions like decrease the magnetic flux density or use a core material of very low permeability have been proposed. Said solutions, besides been very costly, are not sufficient to achieve such noise reduction.

In view of this, the use of acoustic enclosures partially or completely covering the transformer has been proposed. U.S. Pat. No. 3,077,946, discloses examples of this type of systems, said document discloses an electric power transformer comprising a tank rigidly mounted on a basis having a nucleus, windings, an isolator, means for cooling, and an outer coating comprising at least a plate acting as a sound reflector means with flexible support means affixed to said tank and said outer coating; however, such coating hampers tank inspection and significantly increases the footprint area thereof, thus increasing difficulties for loading and moving the proposed transformer, and also preventing communication between the transformer external accessories (such as cabinets, valves, etc.) and the internal body.

Patent EP0048990 (B1) protects a noise-reducing housing for a static induction apparatus, comprising a container for holding the main body of the static induction apparatus, a plurality of support reinforcing elements attached to a side plate of the body, and means for noise reduction supported between the support reinforcing elements and the main body, including a noise insulation panel; however, once installed the means for noise reduction, is very difficult to remove them to carry out inspection operations and maintenance of equipment. Besides this, since these noise reduction means do not have acoustic sound-absorber material, the effectiveness of sound reduction obtained is severely diminished.

Patent EP0087121 (B1) protects a mechanical system that allows to decrease noise caused by operation of transformers and reactors, consisting of insulating panels having windows formed by reinforcing channels in the form of a lattice surrounding the outer periphery of the equipment housing. In this system, each sound panel substantially covers the respective window, and is supported on an elastic structure. The disadvantage of such mechanical system is that the design of panels does not coexist with the accessory outlet, so that the channel-type reinforcements continue to transmit vibrations to the panel itself, and in absence of an acoustic sound-absorber material, its efficiency is importantly reduced.

Finally, utility model CN201478084 (U) discloses a noise-reduction device for a dry reactor, comprising an upper frame, a lower frame, and a dry coil located between the upper frame and the lower frame. Said noise-reduction device comprises a structure consisting of a pair of curved panels placed in the outer side of a reactor. Said panels have inside a honeycomb structure filled with an insulating material that allows to absorb the vibrations of the reactor body. However, due to its size and design, the removal of one or all the panels of said noise-reduction device, whether for inspection or relocation of the unit, is costly. Also, the proposed design does not coexist with accessories like cabinets, switchers, electric boxes, valves, and on the tank lid there is a range of elements causing interference when wanting to implement this solution.

Systems described above also have the inherent disadvantage of requiring complicated attaching systems, which in many cases are integrally formed with the transformer body. Also, systems described above require a complete disassembly of the reactor or transformer to allow the exchange of noise-suppression systems in case of wear or failure.

In view of the above problems, there is a need to provide an easy-to-install, and also removable acoustic panel to efficiently reduce the acoustic pollution caused by operational noise of the transformer.

SUMMARY OF THE INVENTION

In order to efficiently reduce the noise generated by transformers, the present invention aims to provide a low-weight and easy-to-install acoustic panel capable of being replaced to reduce the noise level emitted by the tank walls of a transformer.

A particular object of the present invention is to provide an acoustic panel with suitable means for assembly and fastening to the tank walls of a transformer with low transmissibility that dampens vibrations caused by the operation thereof.

Another object of the invention is to provide an acoustic panel consisting of a plurality of layers that allow to obtain, along with other solutions, a decrease in the noise level below 25 dB, with respect to the standard NEMA TR-1 for a transformer.

Another object of the invention is to provide an acoustic panel with reduced dimensions, suitable for the surfaces of various types of transformers.

Another object of the present invention is to provide a low-weight acoustic panel having interchangeable elements that allow to make easier transport, installation and maintenance thereof.

Also an object of the invention is to provide an acoustic panel which dimensions, fastening torque and design, prevent that any of its natural frequencies matches the operating frequency of the transformer.

The above objectives and other advantages and present invention shall become apparent from the following detailed description thereof.

DETAILED DESCRIPTION OF THE INVENTION

Figure 1:
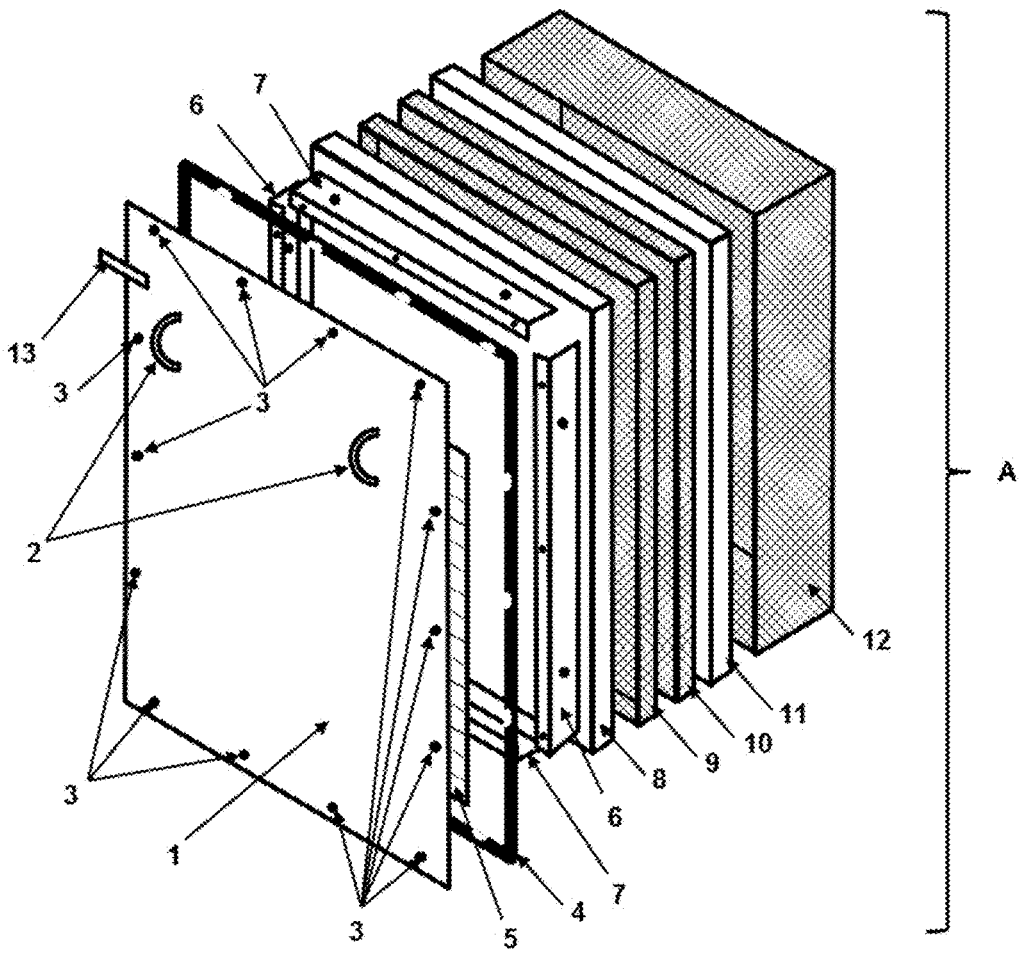
FIG. 1 is an exploded view of the insulation system (A) of the acoustic panel of the present invention.
Figure 2:
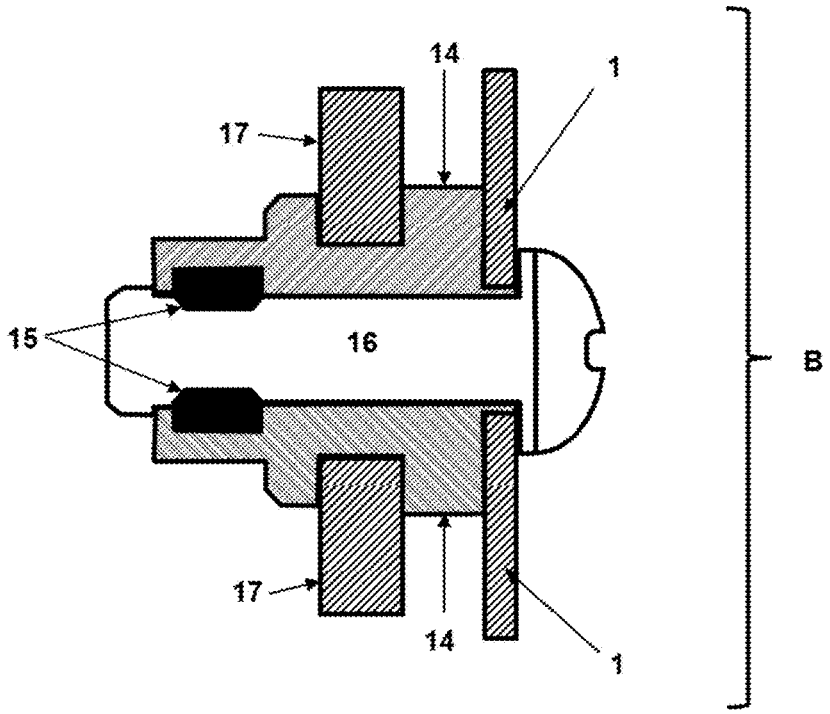
FIG. 2 is a side sectional view of the fastening system (B) of the acoustic panel of the present invention, showing all its elements.
Figure 3:
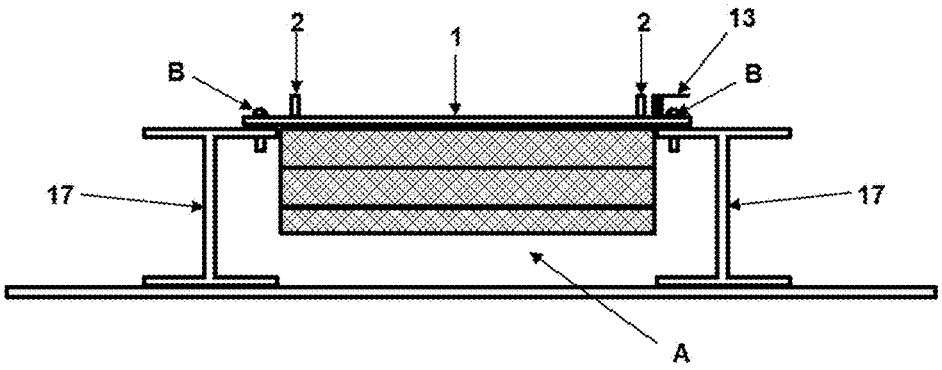
FIG. 3 shows the assembly of the invention on the tank surface of a transformer.
Figure 4:
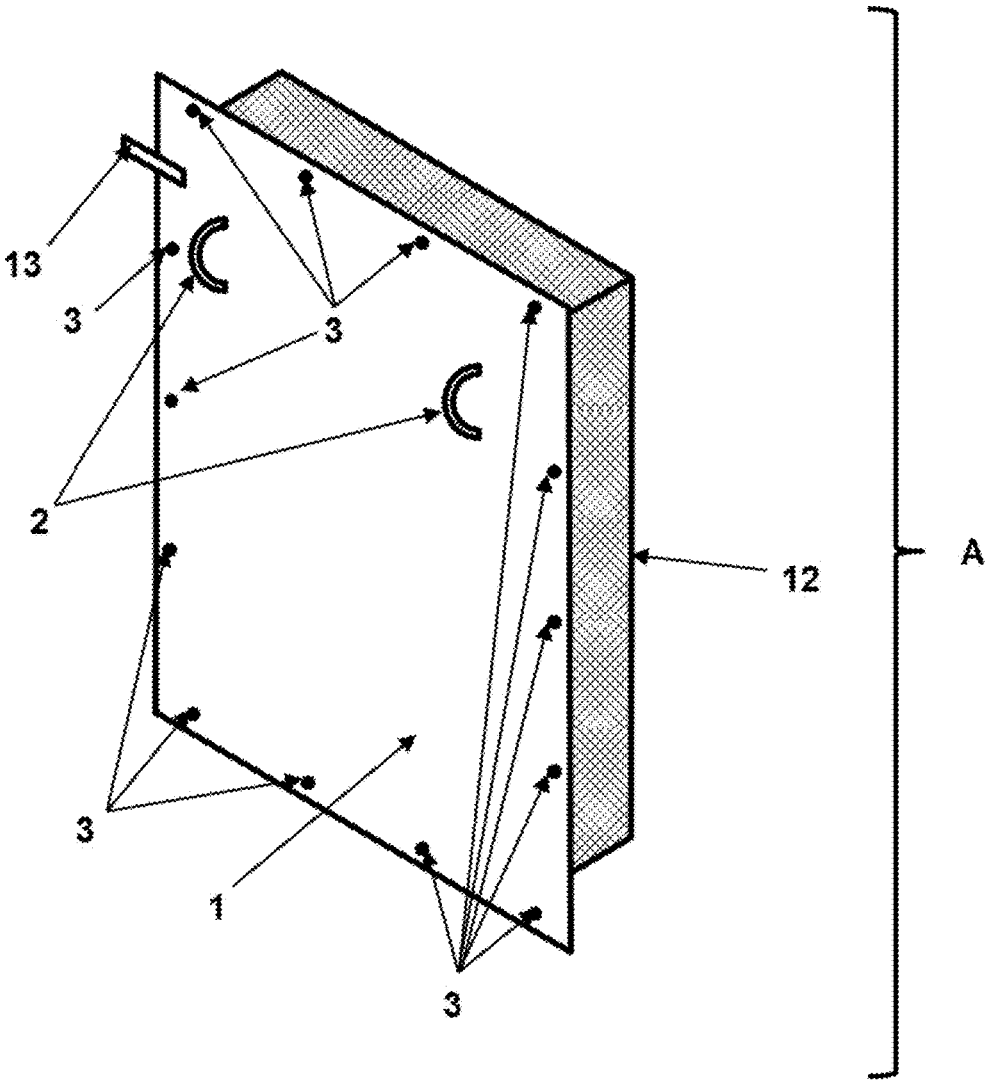
FIG. 4 is a perspective view of the insulation system (A) of the acoustic panel of the present invention fully assembled.

The function of the acoustic panel of the present invention is to act as a barrier against dissemination of noise emitted from the walls of the transformer tank.

The acoustic panel of the present invention allows to dampen the noise caused by the operation of transformers and autotransformers having capacities between 30 and 400 MVA and voltages up to 400 kW. As best seen in FIGS. 1-4, the acoustic panel of the present invention comprises an acoustic insulation system (A) consisting of a plurality of layers with special configuration and a fastening system (B) consisting of a series of absorbing movement supports.

The insulation system (A) comprises a front panel (1), which is a plate of a thickness and a material suitable to absorb and withstand vibrations produced by operation of the transformer. Said panel (1) also comprises a series of perforations (3) along its entire perimeter, equidistantly spaced from each other, a threaded barrel for grounding (13) near one of their upper corners, and a plurality of lifting elements (2), located equidistantly from each other and in the top of the panel (1), to facilitate operations of moving and assembly/disassembly. On the inner surface of said panel (1) a plurality of metal components (5) are disposed, covered by a viscoelastic material and a strip type packing (4) substantially with the same dimensions as those of the plate (1), with slots corresponding to the perforations (3) of the panel (1). Over prior arrangement, a layer of mineral wool (8) is placed, followed by two spacers (9 and 10), and a second layer of mineral wool (11), being both layers of mineral wool (8 and 11) located inside of the two spacers (9 and 10) respectively, which in turn are contained in a mesh box (12) that covers all the assembly and is attached to the internal part of the panel (1) through two pairs of angles, vertical (6) and horizontal (7), that bind the entire assembly, having the insulation system (A) once assembled, a thickness and dimensions suitable to accommodate to the outer surfaces of the transformer.

On its part, the fastening system (B) is comprised by a plurality of damped fastening elements (14) having clamping (1 5) and tightening (16) elements that allow to absorb the vibratory motion of the outer tank of the transformer to avoid the transmission of vibrations to and from the insulation system (A).

To install the acoustic panel of the present invention, the plurality of fastening elements (14) are placed inside each of the perforations (3). Subsequently, each of the fastening elements (14) is matched to one support member (17) located on the surface of the outer tank of a transformer, consisting of a suitably bent plate having perforations corresponding to each of the perforations (3) of the panel (1). Once the acoustic panel is put in place, the clamping parts (15) are tightened and the connection is made to ground the panel (1) by a copper wire (17) which is linked to the threaded barrel for grounding (13) in one end and to the body of the transformer tank in the other end.

Once placed in its operating position, the panel has a working temperature range from −25 to 45° C., and a lifetime of not less than 20 years in outdoor conditions. Also it allows to absorb efficiently the vibrations and noise caused by the operation of the transformer, with a fastening insulation rate of about 70-100%, and a natural frequency below the operation frequency of the transformer.

EXAMPLE 1

Noise Level Reduction Tests

To check the decrease of the noise level obtained through the installation of the acoustic panel of the present invention on a power transformer, it was first proceeded to measure the noise emissions caused by the normal operation of a 84 MVA power transformer. The noise measurement was carried out at various operation frequencies, taking as the basis for comparison the emission of ambient noise (row a) and that caused by the normal operation of the power transformer without panels (row n). Once the reference measurements were taken, it was proceeded to place acoustic panels according to the present invention on the outer surface of the power transformer, and the noise level was measured again at the same operation frequencies (row p), obtaining the results illustrated in the plot of FIG. 5.

Figure 5:
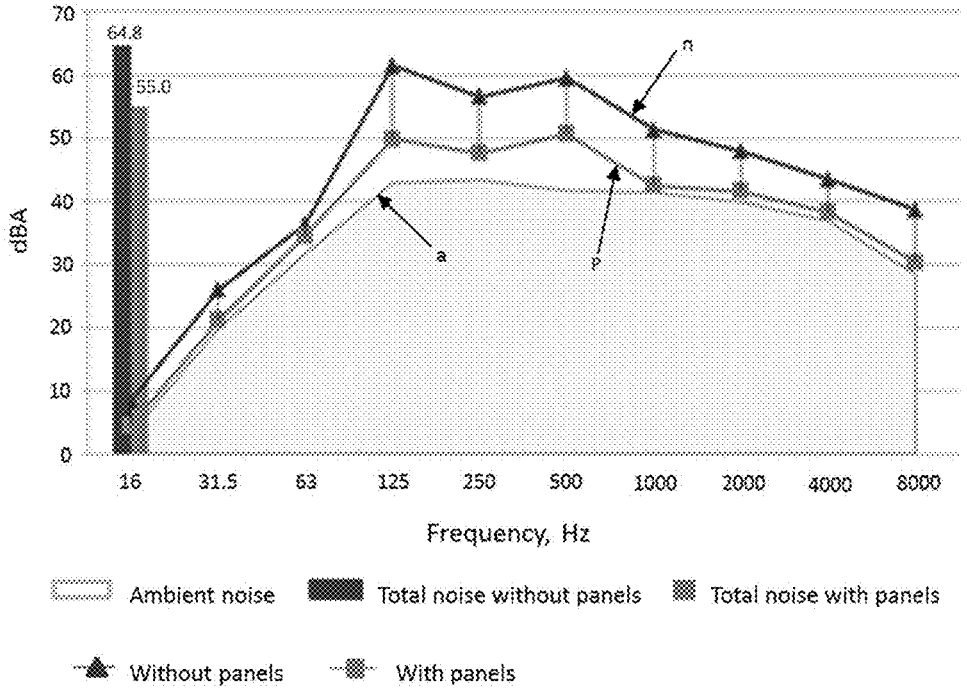
FIG. 5 shows a graph showing the noise level mediations and total noise (total noise=noise without charge+noise with charge) of a 84 MVA potency transformer at different frequencies of work, wherein: line a represents the ambient noise level; line n represents the noise level of the transformer without panels, and line p represents the noise level of the transformer with panels.

As can be seen in the plot of FIG. 5, the results show that the total noise of the transformer (total noise=noise without charge+noise with charge) without panels was 64.8 dBA, while the total noise of the same transformer with the panels of the present invention was reduced to 55.0 dBa. Also, the noise level at all the frequencies measured, was lower when the acoustic panels of the present invention were placed (row p) than that registered without the same (row n), with cases in which the noise level with the panels in place was almost the same that the ambient noise level (row a), especially at measurement frequencies of 31.5 and 1000-8000 Hz. The above results clearly show that the panels of the present invention significantly decrease the noise level.

The present invention has been described with relation to a preferred embodiment; however, it will be apparent to one skilled in the art that modifications can be made thereto without departing from the spirit and scope of the invention.

The invention claimed is:

1. An acoustic panel for transformers, comprising:

a) an insulation system configured to fit outer surfaces of the transformer and comprising: a front panel having a series of perforations along its entire perimeter, equidistantly spaced from each other by a predetermined distance; a threaded barrel for grounding disposed near an upper corner of the front panel; a plurality of lifting elements located equidistantly from each other and in the top of the panel to facilitate operations of moving and assembly/disassembly; a plurality of metal components covered by a viscoelastic material located on the inner surface of said panel; a strip-type packing having substantially the same dimensions as the panel, with slots corresponding to the perforations of the panel, located on the inner surface of the panel; and a layer of acoustic material, two spacers, and a second layer of acoustic material, wherein the two layers of acoustic material, respectively, are situated inside the two spacers, and contained within a mesh box attached to the inner part of the panel through two pairs of angles, vertical, and horizontal that bind the entire assembly;

b) a fastening system, comprising a plurality of damped fastening elements, having clamping and tightening elements to absorb the vibratory motion transmitted by an outer tank of the transformer, wherein the plurality of fastening elements is placed inside the perforations of the panel and matched to a support member located on a surface of the outer tank of the transformer to tighten them, and the acoustic panel is attached to the body of the transformer tank to reduce the noise level, preventing panel resonance.

2. The acoustic panel according to claim 1, wherein the panel of the insulation system is a plate of a thickness and a material configured to absorb and withstand vibrations produced by operation of the transformer.

3. The acoustic panel according to claim 1, wherein the acoustic panel is operated at a temperature in the range of −25 to 45° C.

4. The acoustic panel according to claim 1, wherein the acoustic panel has a lifetime of 20 or more years.

5. The acoustic panel according to claim 1, wherein the acoustic panel has a fastening insulation rate in the range of 70-100%.

6. The acoustic panel according to claim 1, wherein the acoustic panel has a natural frequency below an operation frequency of the transformer.

* * * * *